US006015322A

United States Patent [19]

White et al.

[11] Patent Number: 6,015,322

[45] Date of Patent: Jan. 18, 2000

[54] METHOD OF MAKING SPARK IGNITION ELECTRODE ASSEMBLY

[75] Inventors: David Baker White, Princeton; Darryl Williams, Plainfield, both of Ill.

[73] Assignee: Harper-Wyman Company, Aurora, Ill.

[21] Appl. No.: 09/185,250

[22] Filed: Nov. 3, 1998

Related U.S. Application Data

[62] Division of application No. 08/931,014, Sep. 15, 1997.

[51] Int. Cl.[7] ..... F23Q 3/00

[52] U.S. Cl. ..... 445/7; 264/618

[58] Field of Search ..... 445/7; 264/618

[56] References Cited

U.S. PATENT DOCUMENTS

| | | | |
|---|---|---|---|
| 4,097,977 | 7/1978 | Pollner | 264/618 |
| 4,626,196 | 12/1986 | Stohrer . | |
| 4,810,188 | 3/1989 | Kwiatek . | |
| 4,846,671 | 7/1989 | Kwiatek . | |
| 4,861,264 | 8/1989 | Romanak et al. . | |
| 5,112,218 | 5/1992 | Sigler . | |
| 5,160,255 | 11/1992 | Sigler . | |
| 5,364,264 | 11/1994 | Kwiatek . | |
| 5,397,234 | 3/1995 | Kwiatek . | |
| 5,464,345 | 11/1995 | Kwiatek . | |

FOREIGN PATENT DOCUMENTS 2501576 7/1976 Germany .

*Primary Examiner*—Kenneth J. Ramsey

*Attorney, Agent, or Firm*—Mason, Kolehmainen Rathburn & Wyss

[57] ABSTRACT

A spark ignition electrode assembly includes an electrode wire and an electrically insulative support member receiving and positioning the electrode wire proximate to the gas burner. The electrically insulative support member includes an upper body portion covering the electrode wire. The upper body portion contains a spark ignition passageway for communicating spark ignition discharge between the electrode wire and the gas burner. A ceramic material is formed to define the electrically insulative support member having an electrode wire receiving opening for receiving and positioning an electrode wire proximate to the gas burner and a spark ignition passageway for communicating spark ignition discharge between the electrode wire and the gas burner. The electrode wire is inserted in the electrode wire receiving opening and then the formed ceramic material including the inserted electrode wire is fired.

4 Claims, 2 Drawing Sheets

Fig. 1
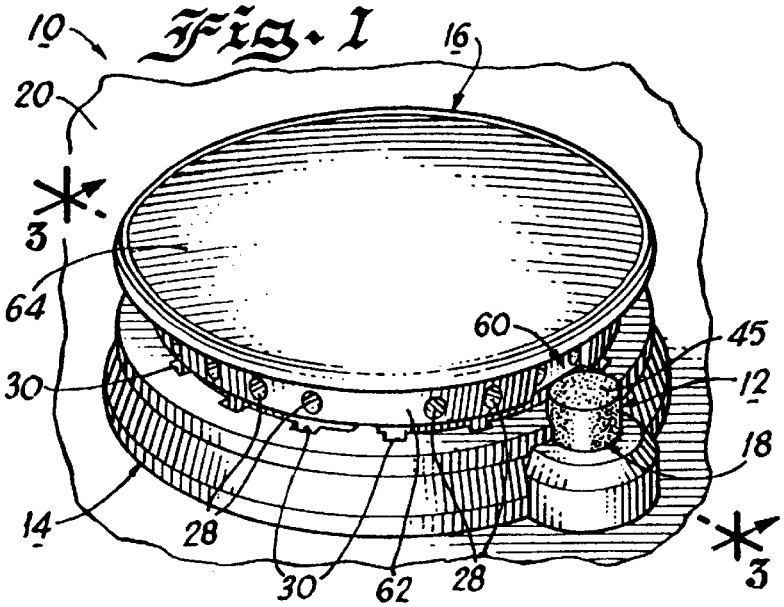
Fig. 2
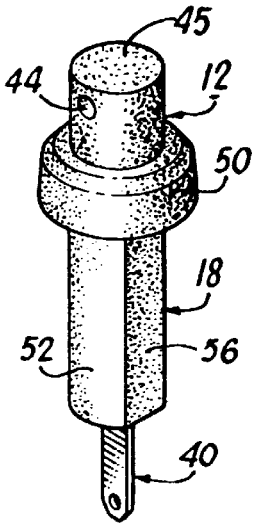
Fig. 3
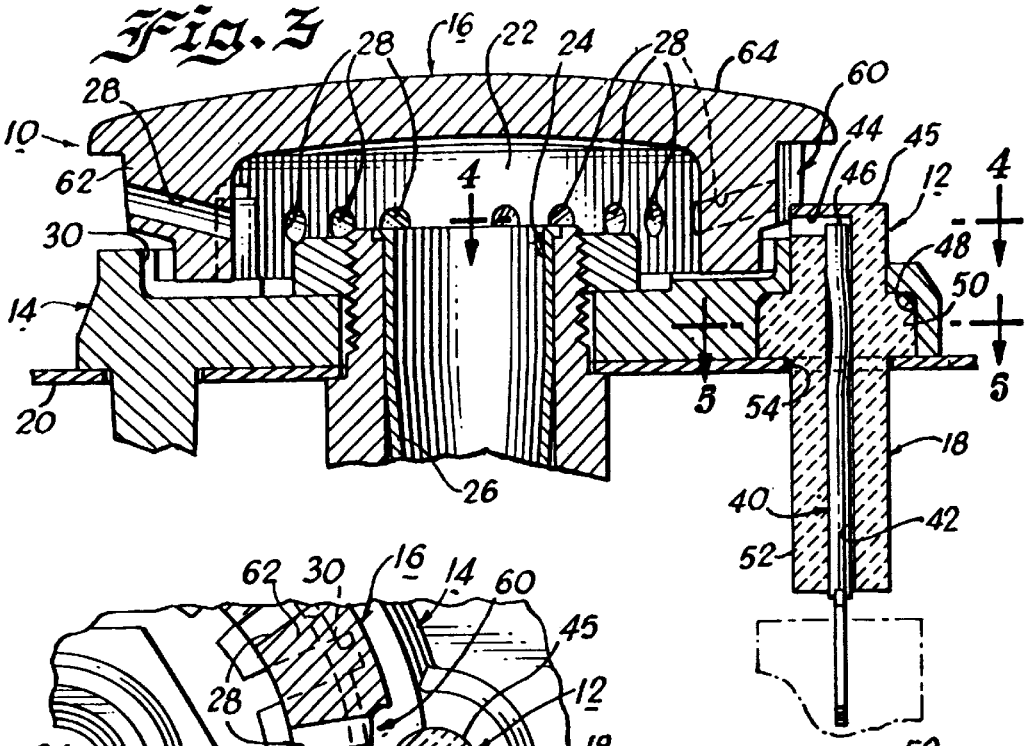
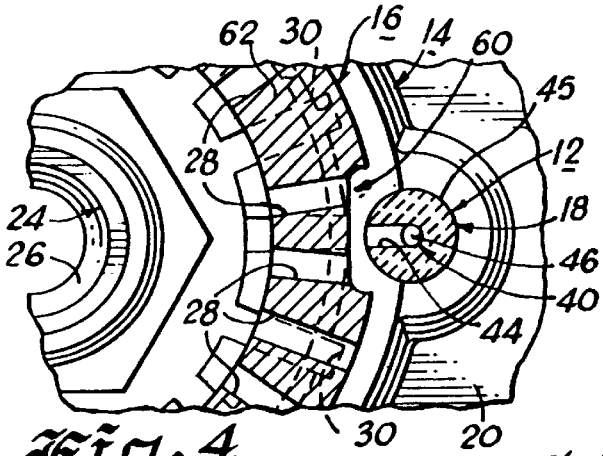
Fig. 4
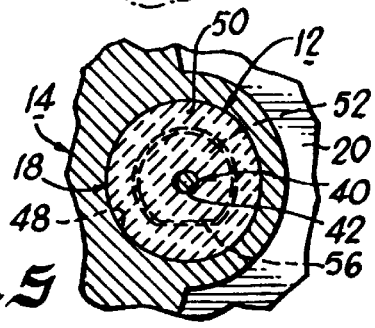
Fig. 5

METHOD OF MAKING SPARK IGNITION ELECTRODE ASSEMBLY

This application is a divisional application of Ser. No. 08/931,014, filed Sep. 15, 1997.

FIELD OF THE INVENTION

The present invention relates generally to spark ignition for gas burners, and more particularly to an improved spark ignition electrode assembly for a gas burner for a gas stove top.

DESCRIPTION OF THE PRIOR ART

Spark ignition typically is used with gas burners. Spark ignition avoids the energy consumption and heat caused by a standing igniter pilot flame that was often used in the past to ignite gas burners, such as gas range top and oven burners. Examples of spark ignited gas burners are provided by U.S. Pat. No. 4,626,196 issued Dec. 2, 1986, U.S. Pat. No. 4,810,188 issued Mar. 7, 1989 and U.S. Pat. No. 4,846,671 issued Jul. 11, 1989, assigned to the assignee of the present invention.

U.S. Pat. No. 5,364,264 issued Nov. 15, 1994, and U.S. Pat. No. 5,397,234 issued Mar. 14, 1995, and assigned to the assignee of the present invention, disclose spark ignition arrangements that eliminate the possibility of electrical shock to the user. The spark electrode assembly includes an electrically conductive electrode contained within an electrically insulative support member. The electrically conductive electrode is positioned by the electrically insulative support member proximate to a predetermined portion of the gas burner. The electrically insulative support member formed of ceramic material has a predetermined wall thickness proximate to the gas burner portion providing a cover for the electrically conductive electrode while allowing a high voltage potential applied to the electrode to discharge through the ceramic material.

While these spark ignited gas burner arrangements provide improvements over many existing spark ignition arrangements, it is desirable to provide an improved spark ignition electrode assembly that provides effective and reliable operation; that is rugged and not easily breakable or damaged both during assembly and use; and that can be easily manufactured.

SUMMARY OF THE INVENTION

Among the principal objects of the present invention are to provide a spark ignition electrode assembly for a gas burner for a gas stove top; to provide a new and improved spark ignition electrode assembly that provides effective and reliable operation; and to provide a spark ignition electrode assembly overcoming one or more of the disadvantages of known spark ignition arrangements.

In brief, the objects and advantages of the present invention are achieved by a spark ignition electrode assembly. The spark ignition electrode assembly includes an electrode wire and an electrically insulative support member receiving and positioning the electrode wire proximate to the gas burner. The electrically insulative support member includes an upper body portion covering the electrode wire. The upper body portion contains a spark ignition passageway for communicating spark ignition discharge between the electrode wire and the gas burner.

A ceramic material is formed to define the electrically insulative support member having an electrode wire receiving opening for receiving and positioning an electrode wire proximate to the gas burner and a spark ignition passageway for communicating spark ignition discharge between the electrode wire and the gas burner. The electrode wire is inserted in the electrode wire receiving opening and then the formed ceramic material including the inserted electrode wire is fired.

BRIEF DESCRIPTION OF THE DRAWINGS

The present invention together with the above and other objects and advantages may best be understood from the following detailed description of the preferred embodiments of the invention illustrated in the drawings, wherein:

FIG. 1 is a perspective view of a gas burner assembly together with a spark ignition electrode assembly constructed in accordance with the principles of the present invention;

FIG. 2 is a perspective view of the spark ignition electrode assembly of FIG. 1 constructed in accordance with the principles of the present invention;

FIG. 3 is an enlarged cross-sectional view taken along the line 3—3 of FIG. 1;

FIG. 4 is a fragmentary cross-sectional view taken along the line 4—4 of FIG. 3;

FIG. 5 is a fragmentary cross-sectional view taken along the line 5—5 of FIG. 3;

FIG. 6 is a fragmentary cross-sectional view similar to FIG. 3 illustrating an alternative spark ignition electrode assembly and mounting arrangement for the spark ignition electrode assembly in accordance with the principles of the present invention;

DETAILED DESCRIPTION OF THE PREFERRED EMBODIMENTS

Figure 8:
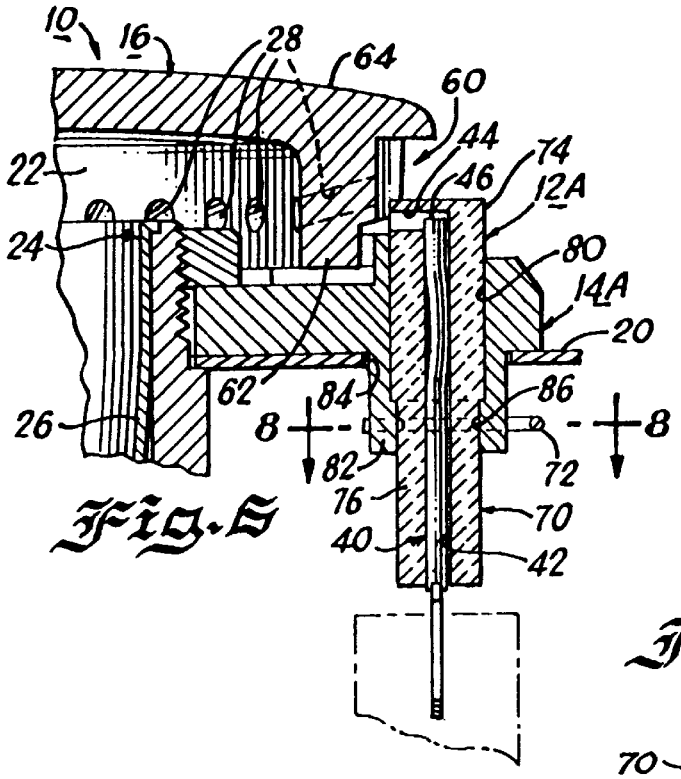
FIG. 8 is a cross-sectional view taken along the line 8—8 of FIG. 6.

Referring now to the drawings, in FIGS. 1–5, there is illustrated a gas burner assembly designated as a whole by the reference character 10 together with a spark ignition electrode assembly designated as a whole by the reference character 12 and arranged in accordance with principles of the present invention. The gas burner assembly 10 includes a burner base 14 and a burner cap 16. In accordance with features of the invention, the spark ignition electrode assembly 12 including an electrode support member 18 is configured for effective and reliable operation while the likelihood of electrical shock to a user is avoided. The spark ignition electrode assembly 12 is rugged and not easily breakable or damaged both during assembly and use.

In FIG. 1, a perspective view of a gas burner assembly 10 is shown with the spark ignition electrode assembly 12 assembled with a gas stove top surface 20. The gas burner cap 16 is supported by gas burner base 14 which together define a burner fuel chamber 22. An inlet 24 to the gas burner base 14 receives a mixture of gas and primary air from a venturi member 26. The gas burner cap 16 includes a plurality of main burner ports 28 where the mixture exits and burns in the presence of secondary air. The gas burner base 14 also includes a plurality of secondary burner ports 30 where the mixture exits and burns in the presence of secondary air. The gas burner base 14 and the gas burner cap 16 are formed, for example, by casting technique of an electrically conductive material, such as aluminum alloy. The secondary burner ports 30 provide a small secondary flame particularly effective for maintaining combustion at low fuel rates. The small secondary flame effectively maintains stable combustion; avoiding externally caused disruptions otherwise resulting, such as, from drafts or an oven door slam. The secondary burner ports 30 are included within the gas burner base 14 without requiring additional machine processes in the manufacture of the gas burner base 14. The spark ignition assembly 12 is operatively positioned outside the burner fuel chamber 22 near main burner ports 28 and secondary burner ports 30.

Having reference also to FIG. 2, there is shown a perspective view of the spark ignition assembly 12 in accordance with principles of the present invention. The spark ignition assembly 12 includes the electrode support member 18 and a spark ignition electrode wire 40. An ignition circuit (not shown) selectively provides a high voltage potential to the electrode wire 40. The gas burner base 14 and cap 16 are provided with an electrical ground potential so that applying high voltage potential to the electrode wire 40 causes ignition sparks to be produced. The electrode wire 40 is an integral member formed of electrically conductive material, such as #310 stainless steel. The electrode support member 18 is formed of an electrically insulative material, preferably a ceramic material, such as an unglazed L5 steatite material.

In accordance with features of the present invention, an electrode wire 40 is inserted into an opening 42 in green ceramic material that forms the electrode support member 18. Then firing of the green ceramic material forming the electrode support member 18 is provided. A firing temperature of about 1550 degrees Fahrenheit or 843 degrees Celsius is used in firing the electrode support member 18. Wet vibratory finishing is provided for scale removal of the electrode wire 40.

Referring to FIG. 3, the opening 42 receiving the electrode wire 40 is sized for an interference fit with the electrode wire 40 after firing. A spark ignition channel or passageway 44 defined in the electrode support member 18 communicating with opening 42 provides a path for ignition sparks from the electrode wire 40. As shown in FIG. 3, the upper end portion 46 of the electrode wire 40 is disposed proximate to the spark ignition passageway 44 formed in an upper portion 45 of the insulative support member 18. The insulative support member upper portion 45 conceals and protects the electrode wire 40 from falling scale, grease, dirt and the like. The insulative support member upper portion 45 covers the electrode wire 40 and protects a user from the possibility of electrical shock. The insulative support member upper portion 45 eliminates requirements of close manufacturing tolerances for a predetermined thickness for a discharge path through the ceramic material, by including the spark ignition passageway 44. The spark ignition passageway 44 has a selected size to facilitate reignition.

A stepped opening 48 is provided through the gas burner base 14 for receiving and positioning the spark ignition assembly 12 relative to the burner ports 28 and 30. The support member 18 enclosing wire 40 extends through the stepped opening 48 with an enlarged upper portion 50 of the support member is seated on and supported by the gas stove top surface 20. A lower, elongated body portion 52 of the support member 18 is slideably received through a corresponding aperture 54 in the gas stove top surface 20 and extends below gas stove top surface 20 for connecting the spark electrode wire 40 to the high voltage potential. The lower, elongated body portion 52 of the support member 18 includes a flat sidewall 56 for keying positioning within the corresponding aperture 54 for positioning the spark ignition passageway 44 and the upper end portion 46 of the electrode wire 40 proximate to burner ports 28 and 30.

The gas burner cap 16 includes an ignition pocket generally designated by 60 formed in a gas burner cap sidewall 62 below a topwall or top 64. The spark ignition passageway 44 and the upper end portion 46 of the electrode wire 40 is positioned proximate to burner ports 28 and 30 within the ignition pocket 60 when the spark ignition assembly 12 is assembled with the burner assembly 10 and the gas stove top surface 20, as been seen in FIGS. 1, 3 and 4.

Figure 7:
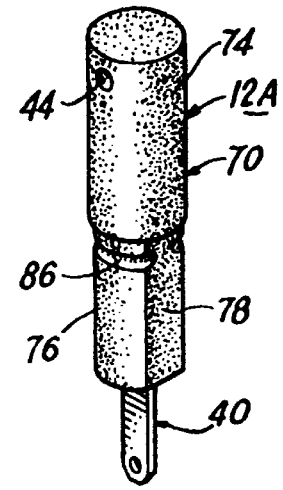
FIG. 7 is a perspective view of the alternative spark ignition electrode assembly of FIG. 6 constructed in accordance with the principles of the present invention.
Figure 8:
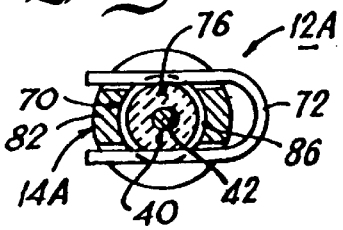

Referring now to FIG. 6, a fragmentary crosssectional view similar to FIG. 3 illustrates an alternative spark ignition electrode assembly generally designated by the reference character 12A and arranged in accordance with the principles of the present invention. In FIG. 7, the alternative spark ignition electrode assembly 12A is shown in perspective view. In FIGS. 6 and 7, the same reference characters as used in FIGS. 1–5 are used for similar or unchanged components. Spark ignition electrode assembly 12A has a different mounting arrangement as compared to the spark ignition electrode assembly 12 of FIGS. 1–5.

Referring to FIGS. 6–8, spark ignition electrode assembly 12A includes a spark ignition electrode wire 40, an electrically insulative support member 90 and a cooperating snap ring member 72 for mounting the assembly 12B with the gas burner assembly 10. Electrically insulative support member 70 includes a spark ignition channel or passageway 44 defined in an elongated upper body portion 74 of the electrode support member 70 communicating with electrode wire receiving opening 42 to provide a path for ignition sparks from the electrode wire 40. Electrically insulative support member 70 includes a lower body portion 76 with a flat sidewall 78 slidingly received through a corresponding opening 80 in a downwardly depending portion 82 the gas burner base 14A for keying positioning with the gas burner assembly 10. The downwardly depending portion 82 is received through a corresponding stove top opening 84. A groove 86 is formed below the upper portion 74 in the electrode support member 70 for receiving the mounting snap ring 72.

Identical materials and an identical method of manufacture are used for the alternative spark ignition electrode assembly 12A as for the spark ignition electrode assembly 12 of FIGS. 1–5. Similarly, the electrode wire 40 is inserted into an opening 42 in green ceramic material that forms the electrode support member 70. Then firing of the green ceramic material forming the electrode support member 70 is provided.

Figure 9:
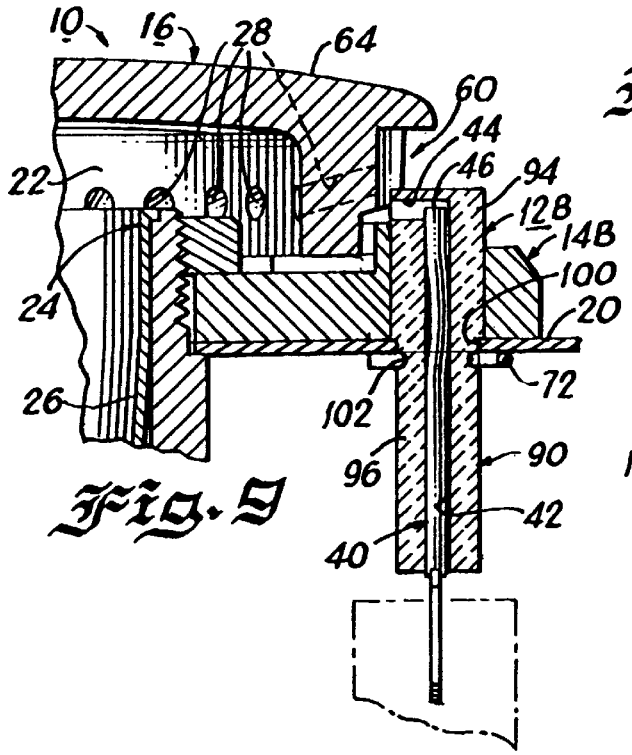
FIG. 9 is a fragmentary cross-sectional view similar to FIGS. 3 and 6 illustrating another alternative spark ignition electrode assembly and mounting arrangement for the spark ignition electrode assembly in accordance with the principles of the present invention.
Figure 10:
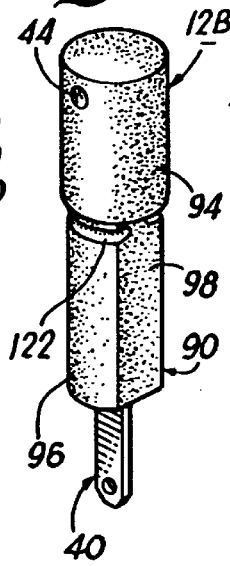
FIG. 10 is a perspective view of the alternative spark ignition electrode assembly of FIG. 9 constructed in accordance with the principles of the present invention.

FIGS. 9 and 10 illustrate another alternative spark ignition electrode assembly generally designated by the reference character 12B and arranged in accordance with the principles of the present invention. Spark ignition electrode assembly 12B includes a spark ignition electrode wire 40, an electrically insulative support member 90 and a cooperating snap ring member 72 for mounting the assembly 12A with the gas burner assembly 10. Electrically insulative support member 90 includes a spark ignition channel or passageway 44 defined in an elongated upper body portion 94 of the electrode support member 70 communicating with electrode wire receiving opening 42 to provide a path for ignition sparks from the electrode wire 40. Electrically insulative support member 90 includes an elongated lower body portion 96 with a flat sidewall 98 slidingly received through a corresponding opening 100 in the stove top 20 for keying positioning with the gas burner assembly 10. A groove 102 is formed below the upper portion 94 in the electrode support member 90 for receiving the mounting snap ring 72 under the stove top 20.

Figure 11:
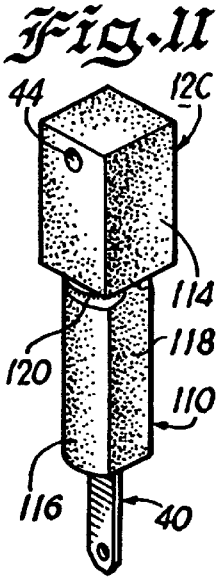
FIG. 11 is a perspective view of a further alternative spark ignition electrode assembly constructed in accordance with the principles of the present invention.

FIG. 11 is a perspective view of a further alternative spark ignition electrode assembly generally designated by the reference character 12C constructed in accordance with the principles of the present invention. Spark ignition electrode assembly 12C includes a spark ignition electrode wire 40, an electrically insulative support member 110 and a cooperating snap ring member 72 (not shown in FIG. 11) for mounting the assembly 12C with the gas burner assembly 10. Electrically insulative support member 110 includes a spark ignition channel or passageway 44 defined in an elongated upper body portion 114 of the electrode support member 110 communicating with electrode wire receiving opening 42 to provide a path for ignition sparks from the electrode wire 40. The elongated upper body portion 114 of the electrode support member 110 has a rectangular configuration. Electrically insulative support member 110 includes a lower body portion 116 with a flat sidewall 118 slidingly received through a corresponding stove top opening 100. A groove 120 is formed below the upper portion 114 in the electrode support member 110 for receiving the mounting snap ring 72 under the stove top 20.

Identical materials and an identical method of manufacture are used for the alternative spark ignition electrode assemblies 12B and 12C as for the spark ignition electrode assembly 12 of FIGS. 1–5.

While the present invention has been described with reference to the details of the embodiments of the invention shown in the drawing, these details are not intended to limit the scope of the invention as claimed in the appended claims.

What is claimed is:

1. A method of making a spark ignition electrode assembly for a gas burner comprising the steps of:

forming ceramic material to define an electrically insulative support member having an electrode wire receiving opening for receiving and positioning an electrode wire proximate to the gas burner; said electrically insulative support member including an upper body portion covering said electrode wire and said upper body portion containing a spark ignition passageway for communicating spark ignition discharge between said electrode wire and the gas burner;

inserting said electrode wire in said electrode wire receiving opening; and firing said formed ceramic material including said inserted electrode wire.

2. A method of making a spark ignition electrode assembly for a gas burner as recited in claim 1 wherein said step of firing said formed ceramic material including said inserted electrode wire includes the step of providing a selected firing temperature of above 800 degrees Celsius.

3. A method of making a spark ignition electrode assembly for a gas burner as recited in claim 1 includes the step of providing an integral stainless steel member forming said electrode wire.

4. A method of making a spark ignition electrode assembly for a gas burner as recited in claim 1 includes the step of providing wet vibratory finishing for scale removal from said electrode wire.

* * * * *